US006443329B1

(12) United States Patent
Rochefort et al.

(10) Patent No.: US 6,443,329 B1
(45) Date of Patent: Sep. 3, 2002

(54) CORRUGATED HANGING DISPENSER

(75) Inventors: Oscar Rochefort, Naperville; Eric Lee Rhyner, Lisle; Christophe de Carbonnières, Naperville, all of IL (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 10/043,428

(22) Filed: Jan. 10, 2002

(51) Int. Cl.[7] ..... B65D 35/56
(52) U.S. Cl. ..... 222/105; 206/806; 229/117.8
(58) Field of Search ..... 222/92–107, 181.2, 222/181.9, 181.3; 229/117.3; 206/806

(56) References Cited

U.S. PATENT DOCUMENTS 4,815,631 A * 3/1989 Eeg et al. ..... 222/105
4,949,845 A * 8/1990 Dixon ..... 206/806
5,341,923 A * 8/1994 Arasim ..... 206/806
6,145,665 A * 11/2000 Krahn ..... 206/806

* cited by examiner

*Primary Examiner*—Philippe Derakshani
*Assistant Examiner*—Thach H. Bui
(74) *Attorney, Agent, or Firm*—Dick and Harris

(57) ABSTRACT

A dispensing container for fluent material, which container is intended to be hung vertically from a support, such as a hook, is provided. The dispensing container has a tubular body, with a bottom dispensing region that is configured to promote the collection of the fluent material and guidance of the fluent material toward the inlet aperture of a dispensing nozzle that is received in the side of the bottom dispensing region. The dispensing container is preferably fabricated from corrugated paperboard or similar material, and is preferably configured to serve as the shipping container for the fluent material as well, so as to reduce or eliminate the need for a further outer shipping container. The fluent material may be contained within a separate liner structure, within the surrounding tubular body, in a "bag-in-box" type of container arrangement.

28 Claims, 2 Drawing Sheets

CORRUGATED HANGING DISPENSER

BACKGROUND OF THE INVENTION

1. Field of the Invention

The present invention is directed to cartons fabricated from paper, paperboard and/or corrugated paperboard. In particular, the present invention is directed to cartons that are configured to be hung vertically to serve as a dispenser for fluent materials.

2. Prior Art

Hanging dispensers are known, for dispensing fluent materials such as liquid or finely powdered soap, detergent and the like. Such prior art dispensing devices are typically fabricated from plastic, glass and/or metal. In addition, such prior art devices are typically permanently mounted devices, which to remain useful, must be refilled when the existing supply of fluent material has been exhausted. Such refilling may require filling a storage portion of the device from a larger container of material (e.g., by pouring from one to the other). Such a process can be time consuming and lead to spillage and waste. Alternatively, some prior art dispensing devices employ interchangeable and/or replaceable canisters or cartridges.

It would be desirable to replace such permanently installed dispensing devices, with disposable devices that may simply be discarded, upon exhaustion of the contents.

It would also be desirable to provide a disposable hanging dispensing device that can be readily recycled, either in whole or in part.

It would further be desirable to provide disposable hanging dispensing devices that can also serve the dual purpose of being the shipping container for the fluent material, which is to be dispensed, without requiring a separate container for the fluent material.

These and other desirable characteristics of the present invention will become apparent in view of the present specification, including claims, and drawings.

SUMMARY OF THE INVENTION

The present invention is directed, in part, to a dispensing container, operably configured to be suspended from a support for the facilitated dispensing of fluent material. The dispensing container comprises a generally tubular body, having a closure structure disposed proximate an opening in an upper portion of the tubular body.

The tubular body further has a bottom dispensing region, having an internal cross-sectional area that decreases from an upper portion of the bottom dispensing region to a lower portion of the bottom dispensing region for collecting and guiding fluent material contained therein toward a localized area.

The tubular body, including the closure structure and the bottom dispensing region, collectively define and enclose a fluent material containment volume.

The dispensing container further comprises nozzle receiving structure, operably disposed in the bottom dispensing region, for securely but releasably, restrainedly receiving a dispensing nozzle so that an inlet aperture of a dispensing nozzle received by the nozzle receiving structure opens onto the fluent material containment region, in the bottom dispensing region.

The dispensing container further comprises hanging support structure, operably connected to the tubular body, to enable the dispensing container to be removably hung upon and supported by a projecting support member.

The generally tubular body is preferably fabricated from at least one of the following materials: paper; paperboard; corrugated paperboard.

In a preferred embodiment of the invention, the closure structure is openable and reclosable, to permit the dispensing container to be reused if desired.

In another preferred embodiment of the invention, the container is operably configured to cooperatively receive fluent material contained in a liner enclosure, as a "bag-in-box" type of container.

In another preferred embodiment of the invention, the generally tubular body has a rectangular cross-sectional configuration, in a plane perpendicular to a longitudinal axis of the dispensing container, along a predominant portion of its length.

The closure structure preferably comprises at least one top closure flap operably configured to span an upper opening of the generally tubular body. Preferably, the bottom dispensing region has an interior configuration in the shape of an inverted pyramid. In a preferred embodiment of the invention, the bottom dispensing region has an exterior configuration in the shape of an inverted gable.

In a preferred embodiment of the invention, the plurality of at least three substantially rectangular side wall panels comprises four substantially rectangular side wall panels, and the bottom dispensing region is formed, at least in part, by front and rear bottom panels having substantially rectangular shapes; right and left bottom panels having substantially triangular shapes.

Preferably, the nozzle receiving structure comprises a nozzle receiving aperture, disposed in the generally tubular body; and a movable nozzle restraining flap, operably configured to be moved to permit the receipt of a dispensing nozzle into the nozzle receiving aperture, and replaced to capture a received dispensing nozzle in the nozzle receiving aperture. In another peferred embodiment of the invention, the nozzle receiving aperture and nozzle restraining flap are operably configured to permit a nozzle to be removably connected to the bottom dispensing region of the dispensing container.

The hanging support structure preferably comprises a hanging flap connected to an upper portion of the generally tubular body; and at least one projecting support member receiving aperture disposed in the hanging flap. The hanging flap preferably further comprises a first portion emanating directly from the generally tubular body; and a folding portion, operably configured to be folded over into juxtaposed position overlying the first portion, wherein at least first and second projecting support member receiving apertures are formed in the first portion and the folding portion, which at least first and second projecting support member receiving apertures are operably configured to align with one another, when the folding portion of the hanging flap is folded over and juxtaposed with the first portion of the hanging flap.

When the container is fabricated from corrugated paperboard material, preferably the flutes of the corrugated paperboard material extend in the blank in a direction parallel to a line extending from the top to the bottom of the generally tubular body.

The dispensing container may be monolithically formed from a single blank.

The present invention also comprises in part a blank for forming a dispensing container, operably configured to be suspended from a support for the facilitated dispensing of fluent material. The blank preferably comprises, in part, a plurality of at least three substantially rectangular side wall panels, operably connected to one another along longitudinally extending lines of weakness extending between adjacent ones of the side wall panels, for enabling the side wall panels to be articulated with respect to one another to form, in part, a generally tubular body having an opening in an upper portion of the generally tubular body. The blank further preferably comprises in part, at least one top closure panel, operably connected to at least one of the side wall panels, along a top peripheral region thereof, for providing a closure structure proximate the opening formed in the upper portion of a generally tubular body formed upon articulation of the plurality of substantially rectangular side wall panels. A plurality of bottom panels are preferably operably connected to at least three side walls, along bottom peripheral regions thereof, which are operably configured, upon articulation of the blank into a container, to enable the formation of a bottom dispensing region having an internal cross-sectional area that decreases from an upper portion of the bottom dispensing region to a lower portion of the bottom dispensing region for collecting and guiding fluent material contained therein toward a localized area.

The plurality of at least three side wall panels, the at least one top closure panel, and the plurality of bottom panels collectively form the generally tubular body and define and enclose, upon articulation of the blank into a container, a fluent material containment volume.

The blank further preferably comprises nozzle receiving structure, operably disposed in at least one of the bottom panels, for securely but releasably, restrainedly receiving a dispensing nozzle, upon articulation of the blank into a container, so that an inlet aperture of a dispensing nozzle received by the nozzle receiving structure opens onto the fluent material containment region, in the bottom dispensing region.

The blank further preferably comprises at least one hanging flap member, operably connected to at least one of the side wall panels, along a top peripheral region thereof, for forming, upon articulation of the blank into a container, hanging support structure to enable the dispensing container to be removably hung upon and supported by a projecting support member.

In a preferred embodiment of the invention, the blank is fabricated from at least one of the following materials: paper; paperboard; corrugated paperboard.

In a preferred embodiment of the blank, the at least one top closure panel is operably configured to be openable and reclosable, to permit the articulated dispensing container to be reused if desired. In one preferred embodiment of the invention, the blank is operably configured, upon articulation into the dispensing container, to cooperatively receive fluent material contained in a liner enclosure, to form a "bag-in-box" type of container.

In a preferred embodiment of the blank, the plurality of at least three substantially rectangular side wall panels comprises four substantially rectangular side wall panels operably connected to one another along longitudinally extending lines of weakness extending between adjacent ones of the side wall panels, for enabling the side wall panels to be articulated with respect to one another to form a generally tubular body having a rectangular cross-sectional configuration, in a plane perpendicular to a longitudinal axis of the dispensing container, along a predominant portion of its length.

In a preferred embodiment of the blank, the plurality of bottom panels, enabling formation of the bottom dispensing region, are operably configured to form, upon articulation of the blank into a container, an interior configuration in the shape of an inverted pyramid.

In a preferred embodiment of the blank, the plurality of bottom panels, enabling formation of the bottom dispensing region, are operably configured to form, upon articulation of the blank into a dispensing container, an exterior configuration in the shape of an inverted gable.

In a preferred embodiment of the blank, the plurality of at least three substantially rectangular side wall panels comprises four substantially rectangular side wall panels, and wherein the plurality of bottom panels comprises, at least in part, front and rear bottom panels connected to respective ones of the side wall panels and having substantially rectangular shapes; and right and left bottom panels connected to respective other ones of the side wall panels and having substantially triangular shapes.

In a preferred embodiment of the blank, the nozzle receiving structure comprises a nozzle receiving aperture, disposed in at least one of the bottom panels; and a movable nozzle restraining flap, operably configured to be moved to permit the receipt of a dispensing nozzle into the nozzle receiving aperture, and replaced to capture a received dispensing nozzle in the nozzle receiving aperture.

In a preferred embodiment of the blank, the nozzle receiving aperture and the nozzle restraining flap are operably configured to permit a nozzle to be removably connected to the bottom dispensing region of a dispensing container formed from the blank.

In a preferred embodiment of the blank, the at least one hanging flap member further comprises at least one projecting support member receiving aperture disposed in the at least one hanging flap member. Preferably, in the blank the at least one hanging flap member further comprises a first portion emanating directly from at least one of the plurality of side wall panels, and a folding portion, operably configured to be folded over into juxtaposed position overlying the first portion, wherein at least first and second projecting support member receiving apertures are formed in the first portion and the folding portion, which at least first and second projecting support member receiving apertures are operably configured to align with one another, when the folding portion of the at least one hanging flap member is folded over and juxtaposed with the first portion of the at least one hanging flap member.

In a preferred embodiment of the blank, the blank is fabricated from corrugated paperboard material, and the flutes of the corrugated paperboard material extend in the blank in a direction parallel to a line extending from the top to the bottom of the generally tubular body formed upon articulation of the blank.

In a preferred embodiment of the blank, the blank is monolithically formed.

The invention also comprises, in part, a dispensing container, operably configured to be suspended from a support for the facilitated dispensing of fluent material.

In this alternative embodiment of the invention, the dispensing container comprises a generally tubular body, having a closure structure disposed proximate an opening in an upper portion of the tubular body. The tubular body further has a bottom dispensing region, having an internal cross-sectional area that decreases from an upper portion of the bottom dispensing region to a lower portion of the bottom dispensing region for collecting and guiding fluent material contained therein toward a localized area. The tubular body, including the closure structure and the bottom dispensing region, collectively form the generally tubular body and define and enclose a fluent material containment volume.

This alternative embodiment of the invention further preferably comprises nozzle receiving structure, operably disposed in the bottom dispensing region, for securely but releasably, restrainedly receiving a dispensing nozzle so that an inlet aperture of a dispensing nozzle received by the nozzle receiving structure opens onto the fluent material containment region, in the bottom dispensing region, with a dispensing nozzle insertably received in the nozzle receiving structure, and having an inlet opening onto the fluent containment region and an openable and reclosable outlet opening onto a region exterior to the dispensing container. Hanging support structure is operably connected to the tubular body, to enable the dispensing container to be removably hung upon and supported by a projecting support member.

DETAILED DESCRIPTION OF THE DRAWINGS

Figure 1:
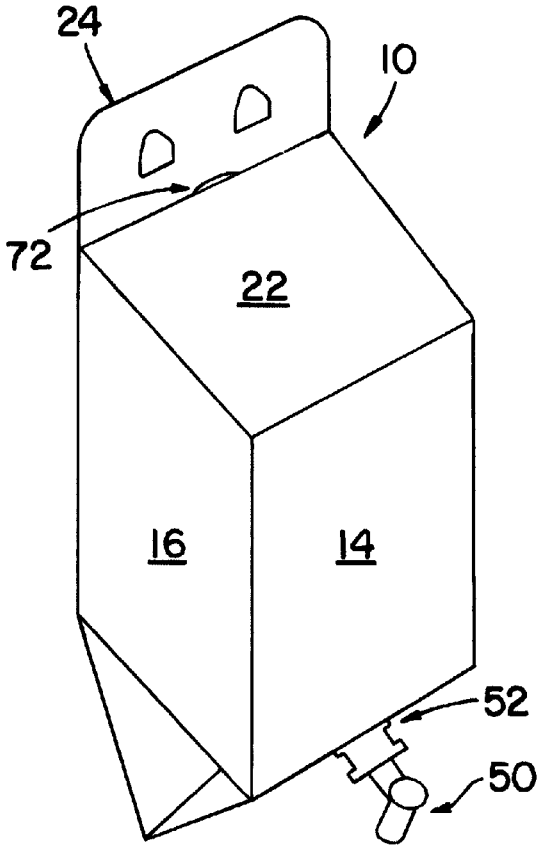
FIG. 1 is a perspective view of a hanging dispenser apparatus according to a preferred embodiment of the invention.
Figure 2:
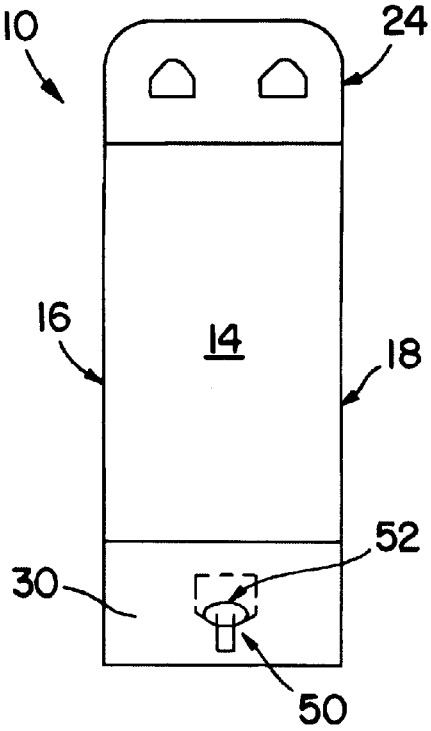
FIG. 2 is a front elevation thereof.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

Dispensing container 10 is illustrated in a first preferred embodiment, in FIGS. 1–4. Dispensing container 10 is shown, in its articulated, assembled form in FIGS. 1–3, being perspective, front and left side views respectively.

Figure 4:
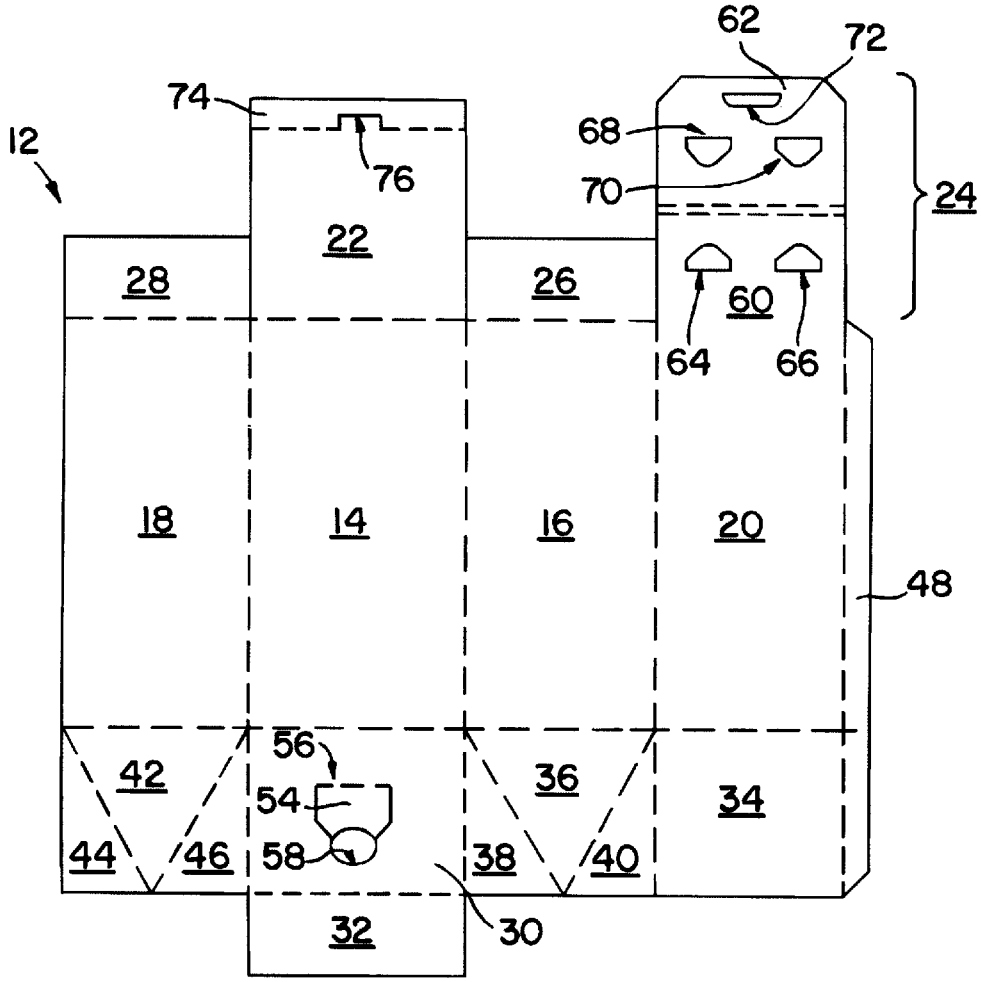
FIG. 4 is a plan view of a blank for the hanging dispenser apparatus of the embodiment of FIGS. 1–3.

FIG. 4 is a plan view of a blank 12 for forming dispensing container 10, with the "inside" surface of blank 12 facing the observer. In FIG. 4, as in the other figures, unless otherwise noted, the usual convention is observed that solid lines on the interior of a figure represent cuts, edges or points of inflection (like a ridge, crease or inwardly or outwardly projecting gusset), and broken or dashed lines indicate folds, score lines or other lines of weakness.

Blank 12 is preferably fabricated from corrugated paperboard, although other similar fiber based materials may be employed. Blank 12 may also be coated, impregnated or laminated, on the inside, outside or both, with materials that may provide moisture resistance, substantially complete liquid barrier characteristics, vapor barrier characteristics or other handling or performance characteristics, as may be desired. Preferably, any such coatings, impregnations or laminations will be made of materials which themselves permit recycling of the entire container 10 (minus nozzle 50 as described herein) without special pre-treatment. In a preferred embodiment of the invention, the flutes are oriented to run vertically in most of the finished container, particularly the large front, left, right and rear side walls, to provide improved strength in the side walls to resist elongation of the side walls under load, especially if the container is to be subjected to a moist or humid environment.

Dispensing container 10 has a front wall 14, left side wall 16, right side wall 18, rear wall 20, top wall 22, hanging flap 24, top closure flaps 26 and 28, bottom front wall 30, bottom closure flap 32, bottom rear wall 34, left bottom panel 36 with adjacent gusset flaps 38 and 40, right bottom panel 42 with adjacent gusset flaps 44 and 46, and container closure flap 48.

Dispensing container 10 typically will also include an openable and securely reclosable dispensing nozzle 50, which may have any particular shape and configuration as may be desired or required by the characteristics of the particular fluent material being dispensed. The fluent material intended to be dispensed may be further contained within a liner bag (not shown), the bottom end of which may be connected to an inner aperture (not shown) of nozzle 50. This will create a "bag-in-box" type of container. Alternatively, the fluent material may not be further confined within a liner bag, and so the inner aperture of nozzle 50 may simply open onto the interior of dispensing container 10. Such dispensing nozzles are well known, and as such, the specific details of the construction of nozzle 50 need not be addressed for the principles of the present invention to be understood by one of ordinary skill in the art having the present disclosure before them. Accordingly, such details of nozzle 50 are generally omitted from the present application.

However, regardless of the specific construction of nozzle 50, it will typically have two axially spaced surrounding retaining flanges, such as outer flange 52 which bears against the outer surface of bottom front panel 30, and a corresponding inner flange (not shown) that will bear against the inner surface of bottom front panel 30, so that nozzle 50 will be securely held in place, to facilitate operation of the nozzle. In order to facilitate installation of nozzle 50, nozzle restraining flap 54, which is pivotable about fold line 56 is provided in bottom front panel 30, adjacent die cut aperture 58. Die cut aperture 58 is preferably configured to have a shape, which conforms to the outer periphery of that portion of nozzle 50 between the inner and outer axially spaced retaining flanges. In a typical nozzle 50, that portion of nozzle 50 between the retaining flanges is circular, so aperture 58, in a typical preferred embodiment, will likewise be circular, and have a diameter slightly greater than the diameter of the portion of nozzle 50 being surrounded.

Hanging flap 24 includes a rigid portion 60 (emanating from the upper portion of rear wall 20) from which folding portion 62 emanates. Rigid portion 60 includes hanging apertures 64, 66. Folding portion 62 includes hanging apertures 68, 70, which, in FIG. 4 are inverted, so that when folding portion 62 is folded over, apertures 68, 70 overlie and align with apertures 64, 66. Folding portion 62 further includes locking aperture 72, the function of which will be described later.

When dispensing container 10 is to be formed, front wall 14, left and right side walls 16 and 18 and rear wall 20 are folded about their respective longitudinal fold lines to form a rectangular tubular body. Closure flap 48 is folded to the inside of right side wall 18 and bottom rear wall 34, and affixed thereto, preferably with any suitable adhesive material.

Figure 3:
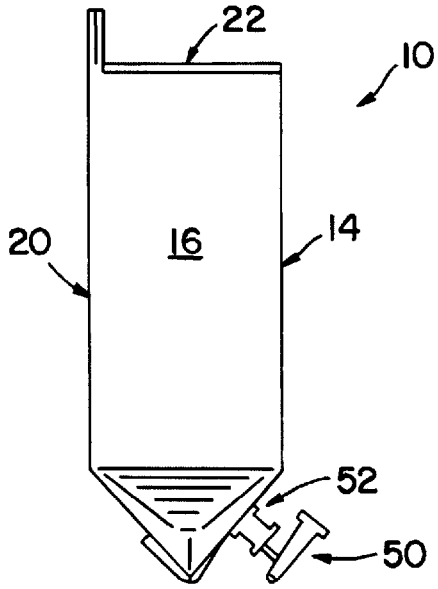
FIG. 3 is a left side elevation thereof, the right side elevation being a mirror image thereof.

Next, formation of the bottom dispensing portion of the tubular body is accomplished, by pushing right and left bottom panels 36, 42, inwardly, causing, in turn, gusset panels 38, 40 and 44, 46 to be pushed inwardly. This movement, in turn, causes the bottom front wall 30 and bottom rear wall 34, to incline toward one another, to form an inverted gable, as shown in FIGS. 1 and 3. Finally, bottom closure flap 32 is folded over to be juxtaposed to the outside surface of bottom rear wall 34 and suitably permanently affixed thereto, such as by a suitable adhesive.

Preferably, the dimensions, proportions and aspect ratios of the various bottom walls and panels are selected, so that when the inward articulation of all the panels is completed, gusset panels 38 and 46 are substantially parallel and juxtaposed to bottom front wall 30, and gusset panels 40 and 44 are substantially parallel and juxtaposed to bottom rear wall 34. In addition, when articulation is completed, the interior configuration of bottom front wall 30, bottom rear wall 34, left bottom panel 36 and right bottom panel 42 form an inverted four-sided pyramid, with all sides sloping to a central bottom point. This inverted pyramidal configuration of the interior bottom is useful in that it promotes the concentration and guidance of the fluent material to a small localized area. Preferably, nozzle aperture 58 is positioned within bottom front panel 30 close to the "point" of the inverted pyramidal shape, so that the fluent material being dispensed is prompted toward the inlet of nozzle 50. In this manner, wastage of fluent material is minimized.

All of the creases and joints in the fully articulated dispensing container 10 may be rendered substantially sift-proof with respect to particulate material and, depending upon whether blank 12 has been coated or laminated as described previously, leakproof with respect to liquid or slurry materials.

Folding portion 62 is then folded over, to the inside of rigid portion 60, and affixed thereto. Folding portion 62 provides container 10 with a double-thickness of material in the regions of apertures 64, 66, 68, 70, which might otherwise be susceptible to tear initiation and propagation by narrow-diameter metal hanging hooks or other similar hanging devices.

Dispensing container 10 may then be filled with the fluent material, whether in a further liner bag or not. If a liner bag is provided, as in a "bag-in-box" type container, typically, nozzle 50 will be already permanently affixed to the bottom of the bag. To install nozzle 50, nozzle restraining flap 54 will be pushed out, the liner bag with nozzle 50 attached, is inserted into dispensing container 10, and nozzle 50 is pushed through aperture 58, so that the inner and outer restraining flanges capture the thickness of bottom front wall 30. Nozzle 20. restraining flap 54 is then tucked back into place, with its bottom periphery captured between the inner and outer retaining flanges of nozzle 50. If no liner bag is used, then nozzle 50 may be installed from the inside out or outside in, as desired or expedient.

Closure of dispensing container 10 is accomplished by folding over top closure flaps 26, 28, and then folding over top wall 22. Top wall closure flap 74 is folded perpendicular to top wall 22. Closure tab 76 is die cut into top wall closure flap 74, so that closure tab 76 projects when top wall closure flap 74 is folded over. Closure tab 76 is inserted between the rear edges of top closure flaps 26, 28, and the inner facing surface of folding portion 62, and closure tab 76 is insertingly received into closure aperture 72.

When the contents of dispensing container 10 have been exhausted, nozzle 50 (with liner bag, if present) may be removed and separately recycled (if fabricated from suitably recyclable materials), and the remaining container 10 may be crushed or otherwise reduced, and recycled using ordinary recycling techniques.

In preferred embodiments of the invention, containers 10 will have rectangular cross-sections (when seen from above) as is the case with the embodiment of FIGS. 1–4, so that containers 10 can be filled with fluent material, and stacked on their sides (such as on pallets), without the need for additional packaging, apart from plastic shrink wrap or other known techniques for restraining unboxed items on shipping pallets or flats. In this manner, container 10 serves not only as a dispenser, but also as the shipping container for the fluent material to be dispensed.

The dispensing container of the embodiment of FIGS. 1–4 is provided with a rectangular cross-sectional configuration, when viewed from above or below. However, it is to be understood that other polygonal cross-sectional configurations may be employed, without departing from the scope of the present invention, as they may be configured to provide a bottom dispensing region that is in the shape of an inverted pyramid, to come to a point at the bottom, while still resulting from an economically shaped and relatively simple blank configuration. For example, a dispensing container having a tubular body with only three sides (resulting in a triangular cross-section when viewed from above) may be readily formed, resulting in a bottom dispensing region in the shape of a three-sided pyramid. Other cross-sectional configurations may be employed, although increasing the number of sides may increase the complexity of the blank and method of articulation of the blank into a functional container, possibly increasing the cost of the container. Fewer than three side walls of course, cannot define a volume, unless one of the side walls is curved and not planar.

The sequence of panels formed in blank 10 as shown in FIG. 4, with the right side wall, front wall, left side wall, and rear wall, proceeding from left to right, with their corresponding top and bottom closure panels and/or hanging flap panels, represents a preferred embodiment of the invention. However, it is to be understood that the illustrated sequence may be varied (i.e., indexed) by one of ordinary skill in the art, having the present disclosure before them, without substantially altering the resultant dispensing container configuration (and thus without departing from the scope of the present invention), as this would simply result in the shifting of the manufacturer's joint from one longitudinally (i.e., vertically) extending corner of the finally erected container to the next.

The foregoing description and drawings merely explain and illustrate the invention, and the invention is not limited except insofar as the appended claims are so limited, as those skilled in the art who have the disclosure before them will be able to make modifications and variations therein without departing from the scope of the invention.

We claim:

1. A dispensing container, operably configured to be suspended from a support for the facilitated dispensing of fluent material, the dispensing container comprising:

a generally tubular body, having a closure structure disposed proximate an opening in an upper portion of the tubular body;

the tubular body further having a bottom dispensing region, having an internal cross-sectional area that decreases from an upper portion of the bottom dispensing region to a lower portion of the bottom dispensing region for collecting and guiding fluent material contained therein toward a localized area, the tubular body, including the closure structure and the bottom dispensing region collectively defining and enclosing a fluent material containment volume;

nozzle receiving structure, operably disposed in the bottom dispensing region, for securely but releasably, restrainedly receiving a dispensing nozzle so that an inlet aperture of a dispensing nozzle received by the nozzle receiving structure opens onto the fluent material containment region, in the bottom dispensing region; and hanging support structure, operably connected to the tubular body, to enable the dispensing container to be removably hung upon and supported by a projecting support member, said generally tubular body being fabricated from at least one of the following materials: paper; paperboard; corrugated paperboard.

2. The dispensing container according to claim 1, wherein the closure structure is openable and reclosable, to permit the dispensing container to be reused if desired.

3. The dispensing container according to claim 1, wherein the container is operably configured to cooperatively receive fluent material contained in a liner enclosure.

4. The dispensing container according to claim 1, wherein the generally tubular body has a rectangular cross-sectional configuration, in a plane perpendicular to a longitudinal axis of the dispensing container, along a predominant portion of its length.

5. The dispensing container according to claim 1, wherein the closure structure comprises at least one top closure flap operably configured to span an upper opening of the generally tubular body.

6. The dispensing container according to claim 1, wherein the bottom dispensing region has an interior configuration in the shape of an inverted pyramid.

7. The dispensing container according to claim 6, wherein the bottom dispensing region has an exterior configuration in the shape of an inverted gable.

8. The dispensing container according to claim 6, wherein the plurality of at least three substantially rectangular side wall panels comprises four substantially rectangular side wall panels, and the bottom dispensing region is formed, at least in part, by front and rear bottom panels having substantially rectangular shapes; right and left bottom panels having substantially triangular shapes.

9. The dispensing container according to claim 1, wherein the nozzle receiving structure comprises:

a nozzle receiving aperture, disposed in the generally tubular body; and a movable nozzle restraining flap, operably configured to be moved to permit the receipt of a dispensing nozzle into the nozzle receiving aperture, and replaced to capture a received dispensing nozzle in the nozzle receiving aperture.

10. The dispensing container according to claim 9, wherein the nozzle receiving aperture and nozzle restraining flap are operably configured to permit a nozzle to be removably connected to the bottom dispensing region of the dispensing container.

11. The dispensing container according to claim 1, wherein the hanging support structure comprises:

a hanging flap connected to an upper portion of the generally tubular body; and at least one projecting support member receiving aperture disposed in the hanging flap.

12. The dispensing container according to claim 11, wherein the hanging flap further comprises a first portion emanating directly from the generally tubular body; and a folding portion, operably configured to be folded over into juxtaposed position overlying the first portion, wherein at least first and second projecting support member receiving apertures are formed in the first portion and the folding portion, which at least first and second projecting support member receiving apertures are operably configured to align with one another, when the folding portion of the hanging flap is folded over and juxtaposed with the first portion of the hanging flap.

13. The dispensing container according to claim 1, wherein the container is fabricated from corrugated paperboard material, and the flutes of the corrugated paperboard material extend in the blank in a direction parallel to a line extending from the top to the bottom of the generally tubular body.

14. The dispensing container according to claim 1, wherein the dispensing container is monolithically formed from a single blank.

15. A blank for forming a dispensing container, operably configured to be suspended from a support for the facilitated dispensing of fluent material, the blank comprising:

a plurality of at least three substantially rectangular side wall panels, operably connected to one another along longitudinally extending lines of weakness extending between adjacent ones of the side wall panels, for enabling the side wall panels to be articulated with respect to one another to form, in part, a generally tubular body having an opening in an upper portion of the generally tubular body;

at least one top closure panel, operably connected to at least one of the side wall panels, along a top peripheral region thereof, for providing a closure structure proximate the opening formed in the upper portion of a generally tubular body formed upon articulation of the plurality of substantially rectangular side wall panels;

a plurality of bottom panels, operably connected to at least three side walls, along bottom peripheral regions thereof, which are operably configured, upon articulation of the blank into a container, to enable the formation of a bottom dispensing region having an internal cross-sectional area that decreases from an upper portion of the bottom dispensing region to a lower portion of the bottom dispensing region for collecting and guiding fluent material contained therein toward a localized area;

the plurality of at least three side wall panels, the at least one top closure panel, and the plurality of bottom panels collectively forming the generally tubular body and defining and enclosing, upon articulation of the blank into a container, a fluent material containment volume;

nozzle receiving structure, operably disposed in at least one of the bottom panels, for securely but releasably, restrainedly receiving a dispensing nozzle, upon articulation of the blank into a container, so that an inlet aperture of a dispensing nozzle received by the nozzle receiving structure opens onto the fluent material containment region, in the bottom dispensing region; and at least one hanging flap member, operably connected to at least one of the side wall panels, along a top peripheral region thereof, for forming, upon articulation of the blank into a container, hanging support structure to enable the dispensing container to be removably hung upon and supported by a projecting support member, the blank being fabricated from at least one of the following materials: paper; paperboard; corrugated paperboard.

16. The blank according to claim 15, wherein the at least one top closure panel is operably configured to be openable and reclosable, to permit the articulated dispensing container to be reused if desired.

17. The blank according to claim 15, wherein the blank is operably configured, upon articulation into the dispensing container, to cooperatively receive fluent material contained in a liner enclosure.

18. The blank according to claim 15, wherein the plurality of at least three substantially rectangular side wall panels comprises four substantially rectangular side wall panels operably connected to one another along longitudinally extending lines of weakness extending between adjacent ones of the side wall panels, for enabling the side wall panels to be articulated with respect to one another to form a generally tubular body having a rectangular cross-sectional configuration, in a plane perpendicular to a longitudinal axis of the dispensing container, along a predominant portion of its length.

19. The blank according to claim 15, wherein the plurality of bottom panels, enabling formation of the bottom dispensing region, are operably configured to form, upon articulation of the blank into a container, an interior configuration in the shape of an inverted pyramid.

20. The blank according to claim 19, wherein the plurality of bottom panels, enabling formation of the bottom dispensing region, are operably configured to form, upon articulation of the blank into a dispensing container, an exterior configuration in the shape of an inverted gable.

21. The blank according to claim 19, wherein the plurality of at least three substantially rectangular side wall panels comprises four substantially rectangular side wall panels, and wherein the plurality of bottom panels comprises, at least in part, front and rear bottom panels connected to respective ones of the side wall panels and having substantially rectangular shapes; and right and left bottom panels connected to respective other ones of the side wall panels and having substantially triangular shapes.

22. The blank according to claim 15, wherein the nozzle receiving structure comprises:

a nozzle receiving aperture, disposed in at least one of the bottom panels; and a movable nozzle restraining flap, operably configured to be moved to permit the receipt of a dispensing nozzle into the nozzle receiving aperture, and replaced to capture a received dispensing nozzle in the nozzle receiving aperture.

23. The blank according to claim 22, wherein the nozzle receiving aperture and the nozzle restraining flap are operably configured to permit a nozzle to be removably connected to the bottom dispensing region of a dispensing container formed from the blank.

24. The blank according to claim 15, wherein the at least one hanging flap member further comprises:

at least one projecting support member receiving aperture disposed in the at least one hanging flap member.

25. The blank according to claim 24, wherein the at least one hanging flap member further comprises a first portion emanating directly from at least one of the plurality of side wall panels, and a folding portion, operably configured to be folded over into juxtaposed position overlying the first portion, wherein at least first and second projecting support member receiving apertures are formed in the first portion and the folding portion, which at least first and second projecting support member receiving apertures are operably configured to align with one another, when the folding portion of the at least one hanging flap member is folded over and juxtaposed with the first portion of the at least one hanging flap member.

26. The blank according to claim 15, wherein the blank is fabricated from corrugated paperboard material, and the flutes of the corrugated paperboard material extend in the blank in a direction parallel to a line extending from the top to the bottom of the generally tubular body formed upon articulation of the blank.

27. The blank according to claim 15, wherein the blank is monolithically formed.

28. A dispensing container, operably configured to be suspended from a support for the facilitated dispensing of fluent material, the dispensing container comprising:

a generally tubular body, having a closure structure disposed proximate an opening in an upper portion of the tubular body;

the tubular body further having a bottom dispensing region, having an internal cross-sectional area that decreases from an upper portion of the bottom dispensing region to a lower portion of the bottom dispensing region for collecting and guiding fluent material contained therein toward a localized area, the tubular body, including the closure structure and the bottom dispensing region collectively forming the generally tubular body and defining and enclosing a fluent material containment volume;

nozzle receiving structure, operably disposed in the bottom dispensing region, for securely but releasably, restrainedly receiving a dispensing nozzle so that an inlet aperture of a dispensing nozzle received by the nozzle receiving structure opens onto the fluent material containment region, in the bottom dispensing region;

a dispensing nozzle insertably received in the nozzle receiving structure, and having an inlet opening onto the fluent containment region and an openable and reclosable outlet opening onto a region exterior to the dispensing container; and hanging support structure, operably connected to the tubular body, to enable the dispensing container to be removably hung upon and supported by a projecting support member.

* * * * *